United States Patent [19]

Denningham

[11] 4,342,210

[45] Aug. 3, 1982

[54] VEHICLE ENTRY LOCKING ARRANGEMENT

[76] Inventor: Clarence E. Denningham, 1220 S. Weinbach Ave., Vanderburgh County, Evansville, Ind. 47714

[21] Appl. No.: 103,337

[22] Filed: Dec. 13, 1979

[51] Int. Cl.[3] ..... E05B 49/00; H01H 9/26; H01H 47/00

[52] U.S. Cl. ..... 70/278; 200/5 E; 361/171

[58] Field of Search ..... 70/278; 361/171; 200/5 B, 5 C, 5 D, 5 E

[56] References Cited

U.S. PATENT DOCUMENTS

| | | | |
|---|---|---|---|
| 3,722,238 | 3/1973 | Ring | 70/278 |
| 4,008,465 | 2/1977 | Le Doux | 361/171 X |
| 4,109,118 | 8/1978 | Kley | 200/5 E |
| 4,233,642 | 11/1980 | Ellsberg | 70/278 X |

FOREIGN PATENT DOCUMENTS

| | | | |
|---|---|---|---|
| 2948 | 7/1979 | European Pat. Off. | 70/278 |
| 279338 | 6/1913 | Fed. Rep. of Germany | 70/278 |
| 133370 | 9/1979 | U.S.S.R. | 70/278 |

*Primary Examiner*—William E. Lyddane
*Attorney, Agent, or Firm*—Frost & Jacobs

[57] ABSTRACT

A pushbutton controlled locking arrangement for a door or other entry, as a trunk lid, to a vehicle which selectively activates circuitry for achieving unlocking upon the engagement of a preselected combination of pushbuttons presented in panel form. The circuitry includes conventional components, such as single-pole and double-pole double-throw relays, electrolytic capacitors, a variable resistor, pushbutton type switches and silicon diodes, all arranged for convenient operation without the necessity of a key. The aforesaid pushbutton panel is typically mounted on the vehicle body proximate the door handle area and affords reliable usage through weatherproof pushbutton switch assemblies.

The system also makes provision for illuminating the pushbutton control panel, the initiation of an optional alarm signaling arrangement in the event of unwanted attempted entry and, as well, overriding control when two pushbuttons are inadvertently depressed at the same time.

9 Claims, 5 Drawing Figures

VEHICLE ENTRY LOCKING ARRANGEMENT

BACKGROUND OF THE INVENTION

As is known, the widespread growth and usage of vehicles, such as automobiles, trucks and the like, has occasioned considerable vehicle thefts, where the conventional key operated door locks presently in use have proven mainly unreliable in thwarting or otherwise avoiding such problem. The same condition is true in connection with key operated locks provided for trunks or specialized storage units found in both private and commercial vehicles.

Additionally, the user oftentime is placed in a situation where the key to the vehicle has been forgotten, lost or misplaced, or even left within the vehicle after locking. Thus, it has become important to develop an arrangement which precludes and/or overcomes the preceding difficulties, and serves both positive locking and unlocking functions.

The invention satisfies such a need in presenting a locking system for a vehicle which, basically, eliminates the necessity of a key. In addition to such, the invention further affords versatile entry to the vehicle, even in the instance where it is desired to leave the vehicle in a running or operating condition while unattended. Moreover, the arrangement provided herein is applicable to trunk or other storage unit access.

Additionally, the invention also affords an optional audible alarm function for added user protection, and, as well, a feature serving override control purposes in the event that more than one pushbutton is simultaneously depressed. Thus, a range of usefulness is presented for optimum consumer acceptance.

In any event, the preceding is accomplished through an arrangement of electronic and electromechanical components which are responsive to depressing a preselected combination of pushbuttons, i.e. the proper operative combination is known only to an authorized party. Broadly, the invention includes, aside from a pushbutton control panel, a layout of electromechanical relays, capacitors, and a variable resistor, functioning through diodes in a manner providing both unlocking and, if desired, alarm functions.

The operation and results achieved by the vehicle entry locking arrangement presented herein is positive and reliable, including the aforesaid override control, where the individual pushbutton is weathertight for eliminating mechanical failures. As will become apparent, the utilized components are commercially available and representative of ready assembly and installation.

A better understanding of the present invention will become more apparent from the following description, taken in conjunction with the accompanying drawings, wherein.

Figure 1:
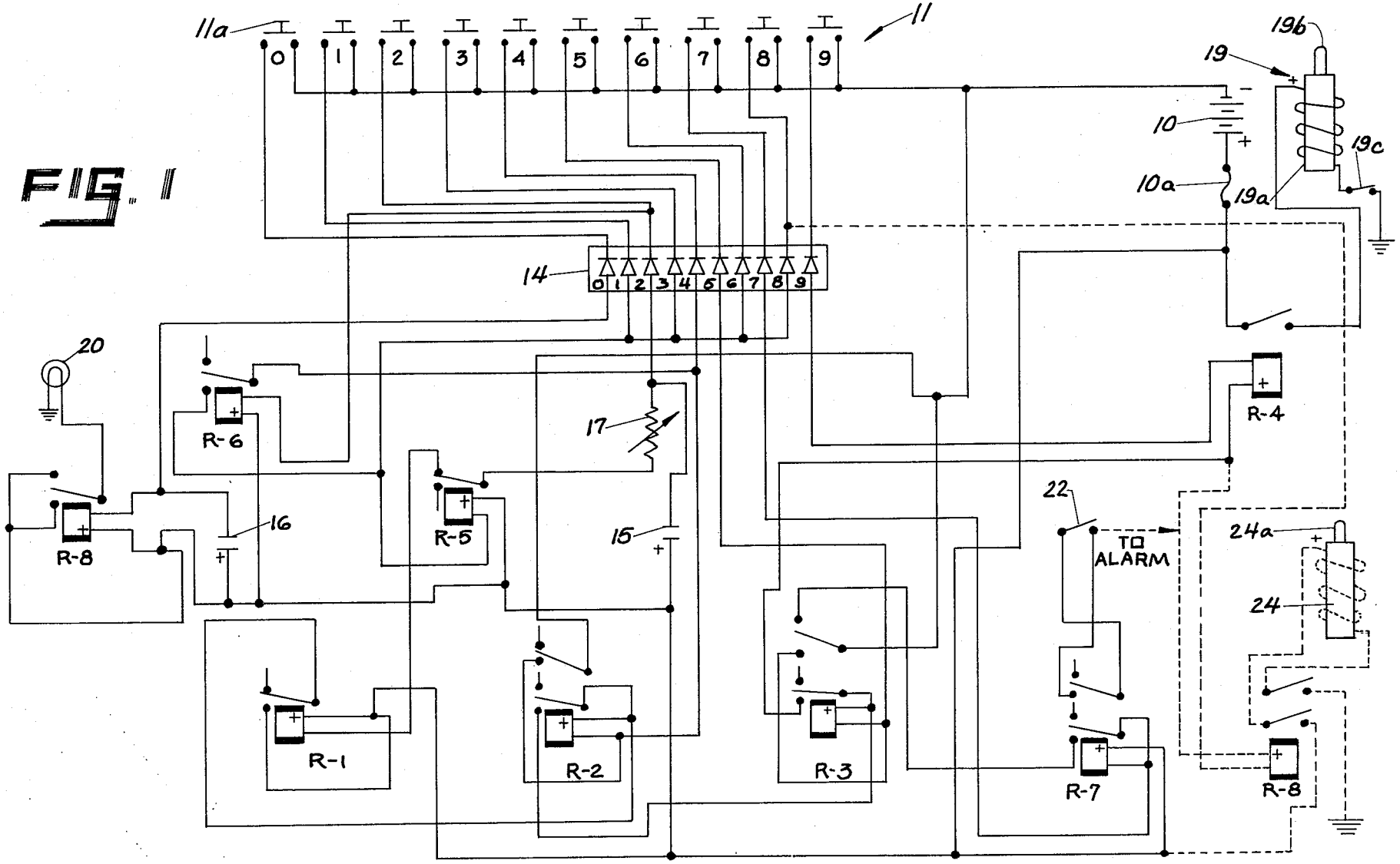
FIG. 1 is a schematic diagram of the circuitry underlying the vehicle entry locking arrangement of the invention, where the broken line portions represent optional trunk lid and alarm functions.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications of the illustrated device and such further applications of the principles of the invention as illustrated therein being contemplated as would normally occur to one skilled in the art to which the invention relates.

Referring now to FIG. 1, the circuitry defining the arrangement of the invention, powered by the vehicle battery or like power source 10, with associated fuse 10*a*, includes a panel or series of momentary type pushbutton switches 11, typically ten in number and identified, for ready reference, as zero, one, two, three, etc., through nine. Diodes 14, such as the silicon type, operatively connected to the aforesaid pushbutton switches 11, bear corresponding identification numbers.

The system further includes electrolytic capacitors 15 and 16, a variable resistor 17 for timing control, and electromechanical relays R-1, R-2, R-3 and R-7, such being of the double-pole double-throw type, and R-5 and R-6, both single-pole double-throw. Relay R-4, single-pole double-throw, provides connection to a solenoid controlled door or like entry unlocking mechanism 19 (representatively shown). On the other hand, relay R-8, also single-pole double-throw, serves in connection with a light source 20 which is provided to aid in pushbutton switch 11 selection in the event of darkness.

A further relay R-9 is included in the instance where other entry control, such as for a trunk lid, is selected. As stated, provision can also be provided, through a switch 22, for optionally interconnecting the system with any desired alarm arrangement, as an audible signal.

At the outset, the circuitry involved for each combination of pushbutton switches 11 is customized to achieve proper sequential operation. In other words, importance lies in the fact that if the proper pushbutton switch 11 is selected to initiate an unlocking sequence, but the second or successive pushbutton switch depressed is improper, the system becomes inoperative, meaning that unlocking cannot be achieved. Moreover, and depending upon the circuitry for the desired preselected pushbutton switch 11 combination, current flow is initiated to the first electromechanical relay, i.e. the first with respect to the first pushbutton switch 11 of the unlocking sequence. As indicated, the system is completed to ground at the negative side of each of the pushbutton switches 11.

In any event, the circuitry described herein, and by way of example, is for a pushbutton switch 11 sequence successively including the pushbuttons identified by numbers 2-4-5-9. Upon depression of pushbutton 2, current flows through the silicon diode 14 numbered 2 (the latter permitting only unidirectional current flow) and electrolytic capacitor 15 to normally open relay R-1. The circuit to relay R-1 is completed through normally closed relay R-5, where variable resistor 17 serves to control or limit the timing of the overall sequence. It should be understood that if relay R-1 remains open, the unlocking sequence cannot begin.

In any event, with the energizing of relay R-1, the positive side of the coil of normally open relay R-2 is energized. At this time, and in order to continue the preselected unlocking sequence, and to actuate relay R-2, pushbutton 4 must be depressed, permitting an electrical connection through the diode 14 numbered 4 to the negative side of the coil of relay R-2. Relay R-2 now closes, causing the energizing of the positive side of the coil of normally open relay R-3. Accordingly, the third phase of the unlocking sequence is ready to be initiated.

The next step is to depress pushbutton 5 to make an electrical path, through the diode 14 numbered 5, to the negative side of the coil of normally open relay R-3, energizing the latter. In other words, at this point, both a positive and a negative electrical connection has been completed to the coil of relay R-3. Relays R-1 and R-2 remain in an energized condition.

When relay R-3 is energized, closing the contacts of such, a positive electrical connection is applied to the coil of the normally open single-pole double-throw relay R-4, i.e. the control to the door or like entry unlocking mechanism. At this time pushbutton 9, in this instance the final pushbutton, is depressed, electrically connecting, through the diode 14 numbered 9, the negative side of the coil of relay R-4.

As a result, relay R-4 closes and actual unlatching operation is achieved by energizing circuitry 19 including a coil 19*a* which causes the mechanical movement of a member 19*b* driving the door or entry latch (not shown) into an unlocked position. The circitry further includes a control switch 19*c* which is already a part of the door unlocking system on the vehicle. In any event, the controlled entry to the vehicle can now be opened.

On the other hand, and if at any time the wrong pushbutton, i.e. a pushbutton not in the desired sequence, is depressed, a circuit will be completed, through the associated respective diode 14, to relay R-5, opening such and thereby disconnecting operation of relay R-1. When the circuit to relay R-1 is opened, the relays R-2 and R-3 will also be disconnected and, accordingly, relays R-1, R-2 and R-3 each return to a normally open position. The entry to the vehicle remains locked.

As a matter of operational sequence, and to afford more positive usage control, if the time lapse between the pushing of the respective pushbutton switches 11, in sequence, is too long, capacitor 15 will discharge, after a preselected time period responsive to the adjustment of variable resistor 17, causing the relays R-1, R-2 and R-3 to each return to a normally open position. Again, the vehicle entry remains locked.

If, at any time, two pushbutton switches 11 are simultaneously depressed, a negative electrical path is completed to the coil of normally open relay R-6. Such action causes the closing of the contacts of relay R-6 which, in turn, permits the energizing of relay R-5. Accordingly, normally closed relay R-5 is now open, disconnecting relay R-1 and, therefore, the operational sequence involving relays R-2 and R-3 until either one or the other of the simultaneously depressed pushbutton switches 11 is released.

As to the alarm system (not shown per se, except for the arrowed broken feed-in line), such is capable of being activated when any one of the numbers in a given preselected combination of pushbutton switches 11 is actuated. For example, in a combination including pushbutton 7, the depressing thereof completes an electrical path, through the diode 14 numbered 7, to the negative side of the coil of normally open relay R-7, whereupon the alarm system can be energized, assuming optional switch 22 for such system is closed, because of the electrical path from the electrolytic capacitor 15 to the positive side of the coil of relay R-7.

The alarm system is functional whenever the contacts of relay R-7 are closed and until the proper unlocking sequence is selected. In other words, for either an audible or visual signal to be initiated, something to which the alarm system responds must be changed or tampered, as forcible entry, where relay R-7 serves the basic purpose of affording use of the alarm system, if and when desired.

In any event, in order to discontinue any possible actuation of the alarm system, the first three digits of the preselected unlocking combination are depressed in proper sequence, and, then, with the depressing of the final digit of the four digit combination, the electrical path through the appropriate diode 14 to the relay R-3 causes the desired inaction, i.e. the opening of the alarm system stand-by or enabling relay R-7.

As to entry to other than the vehicle door, as the trunk lid, for example, the same first three digits of the preselected unlocking combination for the door is usually employed, but the last pushbutton switch number is different. In other words, and in the illustrated example, 2-4-5-9 is the combination for unlocking the vehicle door, where 2-4-5-8 could be the described trunk lid entry combination.

In any event, when pushbutton 8 is depressed, the coil of the normally open trunk relay R-9 (the circuitry for the trunk unlocking function being shown by broken lines) is energized, whereupon trunk release coil 24 is actuated, the latter being achieved by reason of the closing of the contacts of relay R-9. The preceding, in turn, causes mechanical movement of a member 24*a* driving the lid latch (not shown) into an unlocked position.

As to visually sighting the pushbutton switches 11 in the event of darkness, the depressing of pushbutton 0 serves to initiate the illumination thereof through light source or lamp 20. Such action is accomplished by circuitry including capacitor 16 and normally open relay R-8, the capacitor 16 maintaining voltage across the coil of the relay. When the contacts of relay R-8 are closed, lamp 20 is activated, for a preselected interval of time (depending upon capacitor 16), providing, thereby, for the ready viewing of the pushbutton switches 11 of the panel.

In other words, the described circuitry affords multifunctions, to-wit, the selective unlocking of a vehicle door and/or trunk, the maintaining of safety in the event of the usage of an incorrect combination of pushbuttons to achieve unlocking, an override control when two pushbuttons are simultaneously depressed, the provision of an optional alarm operable by an enabling relay, and the lighting of the panel of pushbutton switches 11 in the event of darkness. Further importance lies with the specific arrangement of each weatherproof pushbutton switch 11 in combination with the preceding entry unlocking functions, whereby added reliability is provided for the user.

Figure 2:
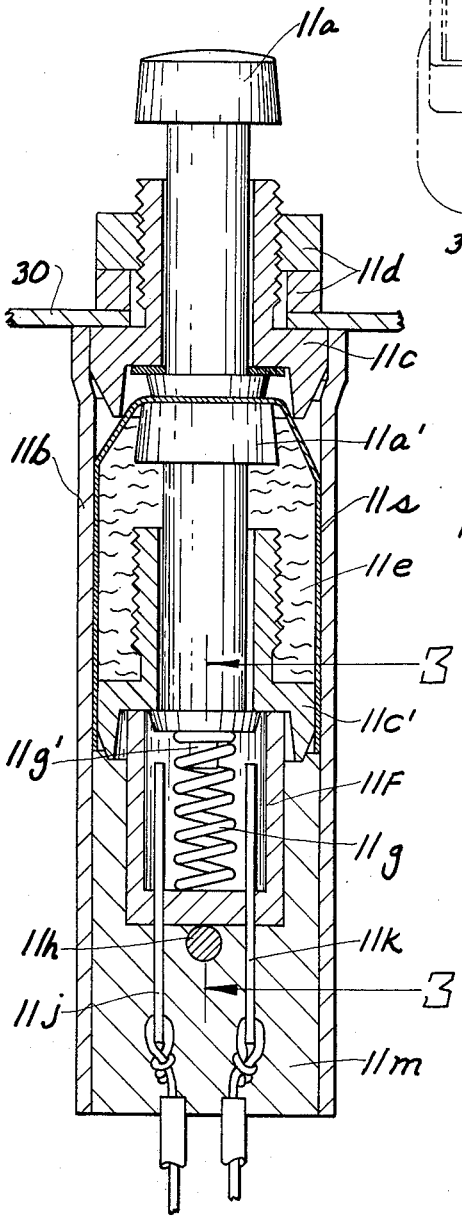
FIG. 2 is a view in vertical section showing a pushbutton switch in accordance with the teachings of the invention.
Figure 4:
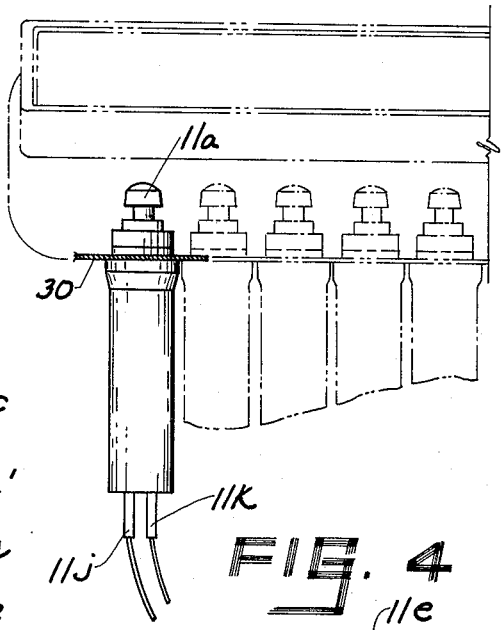
FIG. 4 is a vertical view of the pushbutton switch of FIG. 2 in a typical vehicle installation, with the phantom line representations adding to a fuller understanding of such; and, FIG. 5 is still another view in vertical section of the pushbutton switch of FIG. 2, but showing such when depressed for use.
Figure 5:
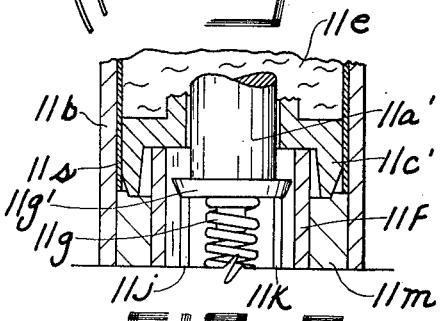
Figure 3:
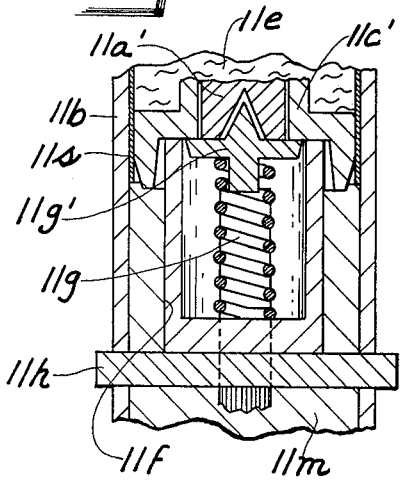
FIG. 3 is another view in vertical section, taken at line 3—3 on FIG. 2 and looking in the direction of the arrows, showing certain details of the instant pushbutton switch.

In this connection, and with reference to FIGS. 2, 3, 4 and 5 (where FIGS. 2, 3 and 5 are greatly enlarged), an individual pushbutton assembly or unit is disclosed which affords effective weatherproof operation. As evident in FIG. 4, the panel of pushbutton switches 11 is typically positioned on the body 30 of the vehicle adjacent to and beneath the door latch (the latter shown in phantom). The preceding position affords ease and convenience in usage, being at an area where the conventional door lock is located.

In any event, each pushbutton switch 11 is defined by a hand-operated pushbutton 11*a* axially movable within a housing 11*b*, typically made from rubber or like flexible material. The pushbutton 11*a* abuts a similar pushbutton 11*a'*, both confined by threaded members 11*c* and 11*c'*, respectively, within the housing 11*b*. The upper threaded member 11*c* is mounted onto the vehicle body 30 by nut-washer combination 11*d*.

A flexible sealing member 11*s* extends between pushbuttons 11*a* and 11*a'* and is wedged at the lower end thereof between a portion of the lower threaded member 11*c'* and the inner wall of the housing 11*b*. Importantly, grease, graphite or like material 11*e* serves as a weather barrier within the space defined by the flexible sealing member 11*s*.

An open ended cylinder 11*f* is received within a cavity at the base of the lower threaded member 11*c'*, where a spring 11*g*, seated at the upper end thereof by element 11*g'*, urges the pushbuttons 11*a* and 11*a'* upwardly, i.e. against pushing action. The cylinder 11*f* is positioned within the housing 11*b* by a laterally extending support bar 11*h*.

Electrical contacts-lines 11*j* and 11*k*, partly embedded within a flow set rubber seal 11*m*, extend into the cylinder 11*f* to selectively contact the element 11*g'* at the bottom of pushbutton 11*a'* for operational purposes. The latter is particularly evident in the showing of FIGS. 3 and 5, including the compressing of spring 11*g* upon the depressing of pushbutton 11*a* and, hence, pushbutton 11*a'*.

In other words, through a sealing/embedded relationship, the pushbutton switch 11 affords a weathertight unit necessary for successful operation of the vehicle entry locking arrangement. As apparent, and in that the pushbutton switches 11 are, of necessity, exposed to the weather for ready contact by the user, a sealed unit of the described type plays importance to the utility of the invention. It should be noted that simple and readily assembled components define the completed control.

As evident from the preceding, the vehicle entry locking arrangement herein affords positive action through versatile interrelated functions. The presented features afford safety and ease of use, representing a valuable contribution to vehicle anti-theft measures.

The circuitry and pushbutton control structure described above is susceptible to various changes within the spirit of the invention, including, by way of example, component substitution, the number of pushbutton switches employed, proportioning and dimensioning as to the pushbutton units, and the like. Thus, the preceding should be considered illustrative and not as limiting the scope of the following claims.

I claim:

1. A vehicle entry locking arrangement comprising circuitry including a plurality of manually operated pushbutton switches, electromechanical relays arranged is a sequentially responsive relationship to a preselected combination of said pushbutton switches controlling unlocking of an entry to said vehicle, an electromechanical enabling relay energized in response to one of said pushbutton switches of said preselected combination and de-energized in response to a subsequently activated pushbutton switch of said preselected combination, where said electromechanical enabling relay serves to activate an independent alarm system, and where said pushbutton switches are each defined by switching elements arranged within a housing in a weatherproof relationship.

2. The vehicle entry locking arrangement of claim 1 where a capacitor controlled electromechanical relay is provided for sequentially timing said entry unlocking.

3. The vehicle entry locking arrangement of claim 1 where the operation of each of said pushbutton switches of said preselected combination controls a corresponding responsive electromechanical relay in said entry unlocking sequence.

4. The vehicle entry locking arrangement of claim 1 where said switching elements are embedded in a sealed relationship within said housing.

5. The vehicle entry locking arrangement of claim 1 where a pushbutton switch not in said preselected combination controls the energization of an electromechanical relay activating a light source illuminating said plurality of pushbutton switches.

6. The vehicle entry locking arrangement of claim 1 where said circuitry is arranged to de-energize the unlocking sequence in the event an electromechanical relay is energized in response to a pushbutton not included in said preselected combination.

7. The vehicle entry locking arrangement of claim 1 where said circuitry is arranged to de-energize the unlocking sequence in the event an electromechanical relay is energized in response to the simultaneous activation of two pushbuttons.

8. The vehicle entry locking arrangement of claim 1 where switch means selectively complete circuitry to said alarm system upon energization of said electromechanical enabling relay.

9. The vehicle entry locking arrangement of claim 1 where a preselected combination of pushbutton switches control one entry unlocking function, and where the substitution of one different pushbutton switch in said preselected combination controls another entry unlocking function.

* * * * *